United States Patent [19]

Owens et al.

[11] 3,991,497

[45] Nov. 16, 1976

[54] INFORMATION STORAGE MEANS

[75] Inventors: Ben Howard Owens; Clyde Eugene LeFevre, both of Orange; James Patrick Hagan, Laguna Beach, all of Calif.

[73] Assignee: Addressograph-Multigraph Corporation, Cleveland, Ohio

[22] Filed: May 8, 1975

[21] Appl. No.: 575,509

Related U.S. Application Data

[60] Continuation-in-part of Ser. No. 464,977, April 29, 1974, abandoned, which is a division of Ser. No. 95,770, Dec. 7, 1970, Pat. No. 3,807,074.

[52] U.S. Cl. ..... 40/78; 40/124

[51] Int. Cl.[2] ..... G09F 11/30

[58] Field of Search ..... 40/78, 79, 63 A, 64 A, 40/106.1, 78.03, 78.07, 78.13, 104.19, 152, 159, 128, 124, 124.1, 68.6

[56] References Cited

UNITED STATES PATENTS

| | | | |
|---|---|---|---|
| 2,330,292 | 9/1943 | Knight et al. | 40/152 |
| 2,630,219 | 3/1953 | Pierce | 40/78.13 X |
| 2,705,436 | 4/1955 | Bradner | 40/124.1 X |
| 2,821,037 | 1/1958 | Westphal | 40/64 R |
| 2,898,807 | 8/1959 | Ewald | 40/78.03 X |
| 3,044,198 | 7/1962 | Badalich | 40/64 A X |
| 3,402,489 | 9/1968 | Schlessel | 40/68.6 |
| 3,419,987 | 1/1969 | Hipp | 40/64 A X |
| 3,736,680 | 6/1973 | Dahl, Jr. | 40/105.5 |
| 3,798,813 | 3/1974 | Dahl, Jr. | 40/105.5 |
| 3,807,074 | 4/1974 | Owens et al. | 40/159 |

FOREIGN PATENTS OR APPLICATIONS

| | | | |
|---|---|---|---|
| 37,850 | 8/1927 | Denmark | 40/104.01 X |
| 1,004,979 | 11/1949 | France | 40/78 |

*Primary Examiner*—Louis G. Mancene
*Assistant Examiner*—John H. Wolff
*Attorney, Agent, or Firm*—Sol L. Goldstein; Michael A. Kondzella

[57] ABSTRACT

A magazine for holding a plurality of microfiche carriers is provided with a pair of oppositely disposed side walls each of which is formed with an elongated arcuate protrusion, a top, a bottom and a front wall having a window therein. The back of the magazine is open to receive the microfiche carriers.

4 Claims, 2 Drawing Figures

10
11
12
13
14
15
16
17
18
19
20
21
22
23
24

10
21
22
23
24
30
31
32
33
34
35
36
37
38
39

INFORMATION STORAGE MEANS

RELATED APPLICATIONS

This is a continuation-in-part of copending application Ser. No. 464,977 filed Apr. 29, 1974, now abandoned which is a division of Ser. No. 95,770, filed Dec. 7, 1970, now U.S. Pat. No. 3,807,074.

BACKGROUND OF THE INVENTION

The present invention relates generally to information storage means but more particularly to storage means for photographically recorded information.

Because of the present day "information explosion", data are being accumulated at such a rapid rate that compact data storage systems are becoming ever more important. One of the most satisfactory data storage systems thus far devised is that of microfilming, wherein sheets of data, reports, books, blueprints, pictures and the like are photographed in a photographically reduced size. Typically, an entire page then requires an area of about half an inch by five-eighths of an inch. These reduced size "frames" are then suitably assembled. This system results in a tremendous compaction of storage space requirements.

One of the early methods of assembling these reduced size frames was to position them, tandem-wise, on a reel of film; but this system had the disadvantage that it became difficult to have access to a single frame without somehow going through every frame that preceded it on the reel.

Another method of assembling the reduced size frames was to print related frames onto a given sheet of film; and this became known as "microfiche". In using the microfiche, a single frame is more readily retrieved when desired, providing "random access" to the desired frame.

The microfiche, during its evolution, has taken a number of different sizes, but at the present time there tends to be a standardization. One of the most popular sizes is about 150 millimeters long and about 105 millimeters wide, and this size of microfiche may be designed to contain from about 60 to over 100 frames. Another popular size for microfiche is a film that is about 5 inches long and about 3 inches wide. Other sizes are also in use.

Similarly, microfiche have taken a variety of formats, the available one hundred some frames being used for data, for titles for for coding.

This diversity of microfiche has hindered the storing and retrieval of microfiche stored data. For example, one arrangement attached a notched metal clip to one edge of the microfiche, the notches being used for data retrieval. Another arrangement notched the actual edge of the microfiche. Still another arrangement utilized punched coding holes along the edge of the microfiche. Some other arrangements used optical approaches and still other arrangements used markings to produce a frequency signal. The main disadvantage of these arrangements was that they required additional equipment and procedures for manufacturing each type of microfiche. Since each arrangement required different retrieval apparatus, it was extremely difficult to intermix microfiche from different sources.

OBJECTS

It is therefore a principal object of the present invention to provide improved information storage means.

Another object of the present invention is to provide a magazine for storage and retrieval of microfiche.

A further object of the present invention is to provide information storage means which is simple and inexpensive to manufacture and which is rugged and dependable in operation.

Other objects and advantages of this invention will become apparent in the course of the following detailed disclosure and description.

SUMMARY OF THE INVENTION

A magazine stores a plurality of microfiche carriers, detent means being used to lock the plurality of microfiche carriers in place in the magazine.

A selected microfiche carrier can be partially ejected from the magazine and manually or automatically placed in a microfiche viewer for viewing a particular frame or frames of the microfiche contained within the microfiche carrier.

The magazine comprises a pair of oppositely disposed side walls, each of which is formed with an elongated arcuate protrusion, a top, a bottom, and a front wall having a window therein. The back of the magazine is open to receive the microfiche carriers.

THE DRAWING

DESCRIPTION OF THE PREFERRED EMBODIMENTS

Figure 1:
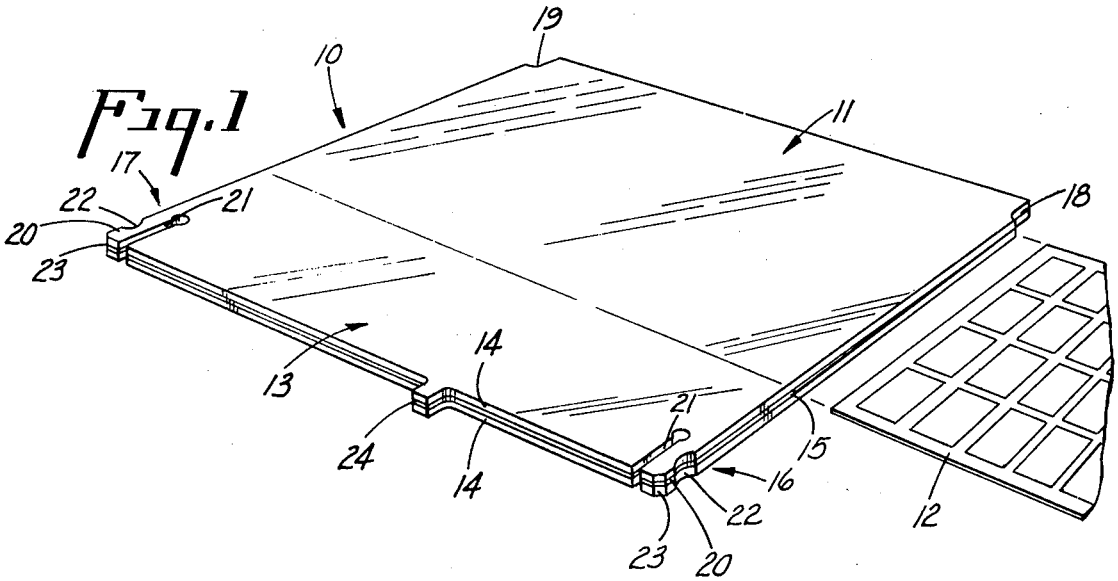
FIG. 1 is a perspective view of an improved microfiche carrier.

FIG. 1 shows a microfiche carrier 10 that takes the form of a plate having a transparent portion 11, adapted to receive a microfiche 12, and an opaque portion 13. Carrier 10 may be formed in any suitable manner, such as by bonding two sheets 14 of a transparent, flexible, slippery material such as Mylar to an opaque sheet 15 of celluloid or other more rigid plastic material so that the two transparent sheets form a folder as shown in FIG. 1. Alternatively, a single transparent sheet can be folded over upon the more rigid plastic material in such a manner that a transparent pocket is formed in the carrier. In any case, the resultant microfiche carrier is a relatively rigid plate in the transparent portion of which a microfiche can be suitably positioned and contained.

Microfiche carrier 10 has two detent elements 16 and 17, positioned at respective front corners thereof and cut-outs 18 and 19 at the rear corners. The illustrated detent elements each comprise an outer flexible leg 20 that can flex transversely, in the manner of a clothes pin. This flexing movement is permitted by a hole-and-slot arrangement 21. Each flexible leg 20 has, on its outer edge, a detent concavity 22, and also has, at its outer end portion, a chamfer 23.

Microfiche carrier 10 also has a coding tab 24 on its front edge. The coding tabs are located at different positions along the front edge of the microfiche carriers so that each tab is offset horizontally from every other tab in a set of carriers.

In use the microfiche carrier of FIG. 1 containing a microfiche is placed, along with other microfiche carriers comprising a set, into a magazine. Because a standard sized carrier is used, microfiche having differing sizes and formats can be intermixed within the magazine.

Figure 2:
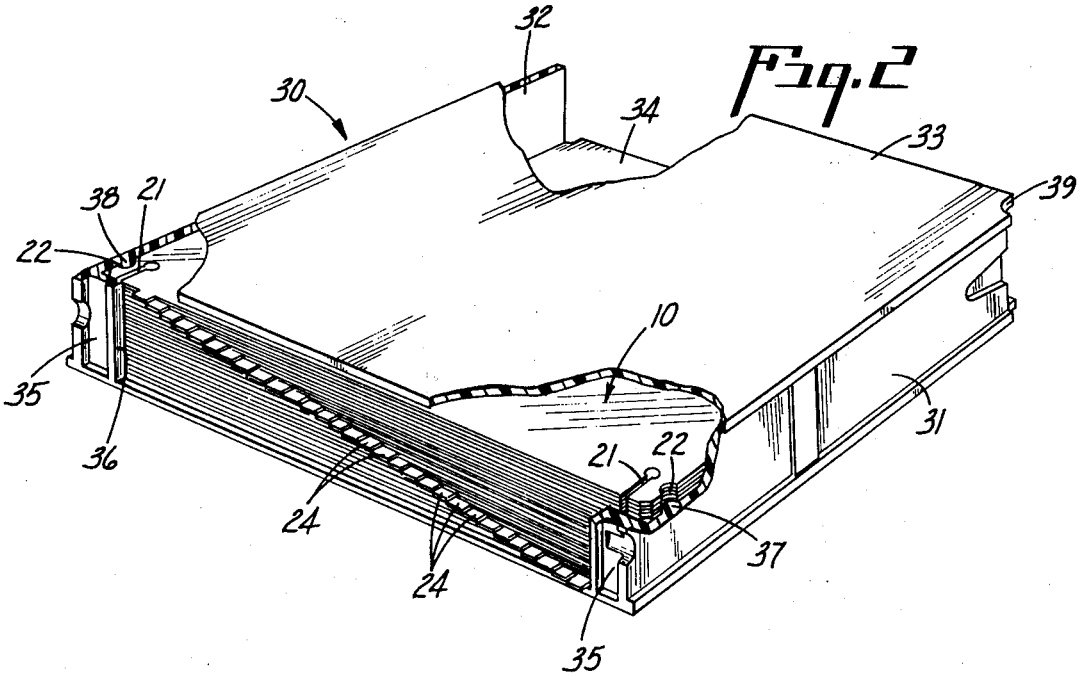
FIG. 2 is a perspective view of a magazine containing a plurality of microfiche carriers showing the magazine and a portion of the carriers partially broken away.

FIG. 2 shows a magazine 30 in which the front corners and one rear corner have been partially broken away. Magazine 30 holds a plurality of microfiche carriers 10. A portion of the microfiche carriers have also been broken away at the rear corner of magazine 30. Each individual carrier contains an individual microfiche 12. The individual microfiche carriers 10 as shown lay on each other without separation. If desired, the magazine may be divided into compartments by means of a suitable separator in order to reduce the weight of the plurality of carriers upon the bottom carrier in each compartment. Magazine 30 may hold about thirty carriers, and be about five-eighths of an inch in height.

Magazine 30 contains side walls 31 and 32, top 33, bottom 34 and front wall 35 containing window 36. The back of magazine 30 is open. The side walls 31 and 32 contain vertically extending protruding arcuate detent elements 37 and 38. The top 33 contains cut-outs 39 at each of the rear corners.

To load magazine 30 the microfiche carriers 10 are inserted into the open back of magazine 30 with the opaque portion 13 containing flexible legs 20 and tab 24 facing towards the front of magazine 30. When chamfers 23 of flexible legs 20 abut the vertically extending protruding arcuate detent elements 37 and 38 on the side walls 31 and 32 of magazine 30, the flexible legs 20 flex inwardly until the movement of microfiche carrier 10 causes detent elements 37 and 38 to engage detent concavities 22 of flexible legs 20 and hold each microfiche carrier 10 securely in place within magazine 30.

Coding tabs 24 of the various microfiche carriers 10 extend outwardly through window 36 of front wall 35 of magazine 30. These coding tabs are short enough so that they do not extend beyond the limits of the magazine. Moreover, the various coding tabs are shown to be staggered or offset horizontally from each other to enable convenient selection of a desired microfiche. This selection can be performed manually or, if desired, by means of a vertically oriented pusher bar which is moved transversely of magazine 30 and by means of which sufficient force can be exerted upon the selected coding tab to disengage the detent concavities 22 of the selected microfiche carrier 10 from the detent elements 37 and 38 of magazine 30 and to partially eject the selected carrier out of the open back of the magazine.

The disclosed invention provides many advantages over prior art systems. First of all, it protects individual microfiche. Second, the disclosed microfiche carrier permits the intermixing of microfiche having differing sizes and formats. Third, it permits the selection and display of any selected frame in a random access manner. Fourth, it permits unlimited storage by having the magazine separate from the readout and display device and permits the magazine to assume any reasonable size. Fifth, the file integrity is protected, because the microfiche are contained in a magazine capable of retaining an entire file or at least a substantial part thereof. Sixth, the data are easily updated by removing a given microfiche carrier and replacing the microfiche contained therein with an updated microfiche.

This invention has been described with reference to certain specific embodiments and to various suggested conditions of operation. However, other embodiments can be utilized in the practice of this invention. It is therefore intended that this invention is not to be limited except as defined in the following claims.

We claim:

1. Storage means for holding a plurality of microfiche comprising the combination of a magazine having oppositely disposed side walls each formed with magazine detent means on the inner surface thereof, a top, a bottom and a front wall having a window therein, the back of said magazine being open, and a plurality of microfiche carriers within said magazine, each of said microfiche carriers having pocket means adapted to carry a microfiche, index means and carrier detent means, said index means projecting into said window and said carrier detent means matingly engaging said magazine detent means, whereby said plurality of microfiche carriers are held securely in place within said magazine and pushing said index means of a selected microfiche carrier through said window releases the carrier detent means of said selected microfiche carrier from said magazine detent means so that said selected microfiche carrier can be retrieved through the open back of said magazine.

2. Storage means according to claim 1 wherein said magazine detent means is an elongated arcuate protrusion and said carrier detent means is a concavity on said microfiche carrier.

3. Storage means according to claim 1 wherein each of said microfiche carriers is equipped with a tab off-set from the tab of each other microfiche carrier within said magazine.

4. Storage means according to claim 1 wherein said plurality of microfiche carriers are positioned immediately adjacent one another in said magazine.

* * * * *